US011566632B2

(12) United States Patent
Jia et al.

(10) Patent No.: US 11,566,632 B2
(45) Date of Patent: Jan. 31, 2023

(54) ELECTRONIC DEVICE AND COOLING FAN

(71) Applicant: Lenovo (Beijing) Co., Ltd., Beijing (CN)

(72) Inventors: Zizhou Jia, Beijing (CN); Hongmei Ge, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 166 days.

(21) Appl. No.: 16/104,700

(22) Filed: Aug. 17, 2018

(65) Prior Publication Data

US 2019/0055958 A1 Feb. 21, 2019

(30) Foreign Application Priority Data

Aug. 17, 2017 (CN) ..... 201710708133.8

(51) Int. Cl.

| | |
|---|---|
| ***F04D 29/38*** | (2006.01) |
| ***F04D 29/32*** | (2006.01) |
| ***F04D 29/30*** | (2006.01) |
| ***F04D 29/28*** | (2006.01) |
| ***F04D 19/00*** | (2006.01) |
| ***F04D 29/66*** | (2006.01) |

(52) U.S. Cl.

CPC ..... *F04D 29/384* (2013.01); *F04D 19/002* (2013.01); *F04D 29/281* (2013.01); *F04D 29/30* (2013.01); *F04D 29/325* (2013.01); *F04D 29/666* (2013.01)

(58) Field of Classification Search

CPC .... F04D 29/666; F04D 29/325; F04D 29/662; F04D 29/667

See application file for complete search history.

(56) References Cited

U.S. PATENT DOCUMENTS

| | | | | |
|---|---|---|---|---|
| 6,318,964 | B1 * | 11/2001 | Yang | B29C 45/006 415/198.1 |
| 6,511,300 | B2 * | 1/2003 | Otsuka | F04D 29/325 417/354 |
| 6,514,036 | B2 * | 2/2003 | Marshall | E01H 1/0809 415/102 |
| 6,540,476 | B2 * | 4/2003 | Huang | F04D 29/282 415/102 |
| 6,572,336 | B2 * | 6/2003 | Horng | F04D 29/023 416/183 |
| 6,648,602 | B2 * | 11/2003 | Horng | F04D 29/666 416/237 |

(Continued)

FOREIGN PATENT DOCUMENTS

| | | | |
|---|---|---|---|
| CN | 1734101 | A | 2/2006 |
| CN | 101285484 | A | 10/2008 |

(Continued)

*Primary Examiner* — Woody A Lee, Jr.
*Assistant Examiner* — Wesley Le Fisher
(74) *Attorney, Agent, or Firm* — Anova Law Group, PLLC

(57) ABSTRACT

A cooling fan and an electronic device are provided. The cooling fan comprises a plurality of blades disposed in a circumferential direction of a rotating shaft. The plurality of blades includes a first blade and a second blade. A windward surface of the first blade includes a first alignment part and a first offset part. The first alignment part is aligned with a windward surface of the second blade, and the first offset part and the windward surface of the second blade are arranged in a staggered manner.

4 Claims, 4 Drawing Sheets

(56) References Cited

U.S. PATENT DOCUMENTS 6,779,992 B2 * 8/2004 Lei ..... F04D 29/38 416/212 R
6,827,555 B2 * 12/2004 Yang ..... F04D 29/30 416/243
7,025,569 B2 * 4/2006 Chang ..... F04D 29/384 416/214 R
7,083,386 B2 * 8/2006 Horng ..... F04D 29/30 416/175
7,182,572 B2 * 2/2007 Yang ..... F04D 29/325 415/175
7,484,925 B2 * 2/2009 Carlson ..... F04D 29/661 415/119
7,997,871 B2 * 8/2011 Hwang ..... F04D 29/30 416/175
9,051,837 B2 * 6/2015 Chiu ..... F04D 29/188
9,206,808 B2 * 12/2015 Yuan ..... F04D 29/281
9,267,507 B2 * 2/2016 Wu ..... F04D 17/162
10,517,190 B2 * 12/2019 Lin ..... F04D 29/305
2002/0094275 A1 * 7/2002 Bostwick ..... F04D 29/281 416/175
2003/0123975 A1 * 7/2003 Horng ..... F04D 29/327 415/119
2004/0202535 A1 * 10/2004 Lin ..... F04D 29/281 415/84
2004/0219022 A1 * 11/2004 Yang ..... F04D 29/329 416/186 R
2005/0063825 A1 * 3/2005 Yang ..... F04D 29/325 416/183
2007/0134097 A1 * 6/2007 Tanahashi ..... F04D 29/281 416/179
2009/0162210 A1 * 6/2009 Hwang ..... F04D 29/281 416/96 R
2012/0251323 A1 * 10/2012 Chiu ..... F01D 5/02 416/198 R
2013/0084187 A1 * 4/2013 Wu ..... F04D 25/166 416/189
2013/0089425 A1 * 4/2013 Wu ..... F04D 25/0613 416/198 R
2013/0129513 A1 * 5/2013 Wu ..... F04D 29/282 416/189
2013/0170995 A1 * 7/2013 Chen ..... F04D 29/668 416/193 R
2014/0072434 A1 * 3/2014 Wu ..... F04D 17/162 416/198 R
2014/0127022 A1 * 5/2014 Cheng ..... F04D 29/281 416/192
2014/0127024 A1 * 5/2014 Yang ..... F04D 17/162 416/211
2014/0127029 A1 * 5/2014 Yang ..... F04D 29/281 416/223 B
2014/0134011 A1 * 5/2014 Chen ..... F04D 25/0613 417/354
2014/0233178 A1 * 8/2014 Franz ..... F04D 19/007 361/679.48
2014/0286752 A1 * 9/2014 Chiou ..... F04D 17/16 415/119
2015/0152879 A1 * 6/2015 Tzeng ..... F04D 19/002 416/223 R
2017/0002833 A1 * 1/2017 Lin ..... F04D 29/281
2017/0363097 A1 * 12/2017 Lin ..... F04D 29/325
2018/0058467 A1 * 3/2018 Lin ..... F04D 29/281
2018/0187693 A1 * 7/2018 Lin ..... F04D 29/281
2018/0187699 A1 * 7/2018 Lin ..... F04D 29/666
2018/0238338 A1 * 8/2018 Tamaoka ..... F04D 29/283

FOREIGN PATENT DOCUMENTS

CN 101358607 A 2/2009
CN 203717439 U 7/2014
JP 2002138993 A 5/2002

* cited by examiner

ELECTRONIC DEVICE AND COOLING FAN

CROSS-REFERENCES TO RELATED APPLICATIONS

This application claims the priority of Chinese patent application No. 201710708133.8, filed on Aug. 17, 2017, the entire content of which is incorporated herein by reference.

FIELD OF THE DISCLOSURE

The present disclosure generally relates to the field of electronic device technology and, more particularly, relates to a cooling fan for cooling heat generating components in an electronic device and an electronic device thereof.

BACKGROUND

In many electronic devices, a cooling fan is installed to dissipate the heat generated by the electronic devices. For some electronic devices, such as laptops, as the size of the electronic devices become more and more compact, the installation space of the cooling fan is getting smaller and smaller, which raise a high quietness performance requirement for the cooling fan. However, an existing cooling fan often has a plurality of blades having the same structure and aligned to each other, which generates substantially large noise and may not meet the desired quietness performance requirement. Thus, how to further reduce the noise of the cooling fan has become a problem desired to be solved by those skilled in the art at present.

The disclosed cooling fan and electronic device thereof are directed to solve one or more problems set forth above and other problems.

BRIEF SUMMARY OF THE DISCLOSURE

One aspect of the present disclosure provides a cooling fan. The cooling fan comprises a plurality of blades disposed in a circumferential direction of a rotating shaft. The plurality of blades includes a first blade and a second blade. A windward surface of the first blade includes a first alignment part and a first offset part. The first alignment part is aligned with a windward surface of the second blade, and the first offset part and the windward surface of the second blade are arranged in a staggered manner.

Another aspect of the present disclosure provides an electronic device. The electronic device comprises a heat generating component and a cooling fan for cooling the heat generating component. The cooling fan comprises a plurality of blades disposed in a circumferential direction of a rotating shaft. The plurality of blades includes a first blade and a second blade. A windward surface of the first blade includes a first alignment part and a first offset part. The first alignment part is aligned with a windward surface of the second blade, and the first offset part and the windward surface of the second blade are arranged in a staggered manner.

Other aspects of the present disclosure may be understood by those skilled in the art in light of the description, the claims, and the drawings of the present disclosure.

BRIEF DESCRIPTION OF THE DRAWINGS

To more clearly illustrate technical solutions of embodiments or in the prior art, accompany drawings which need to be used in the description of the embodiments or the prior art will be simply introduced. Obviously, the accompany drawings in the following description are merely some embodiments, and for those of ordinary skill in the art, other embodiments can further be obtained according to these accompany drawings without contributing any creative work.

In FIGS. 1-4, the various reference numerals and corresponding names are as follows: 1-connector; 2-blade; 21-first blade; 22-second blade; and 23-third blade.

DETAILED DESCRIPTION

Figure 1:
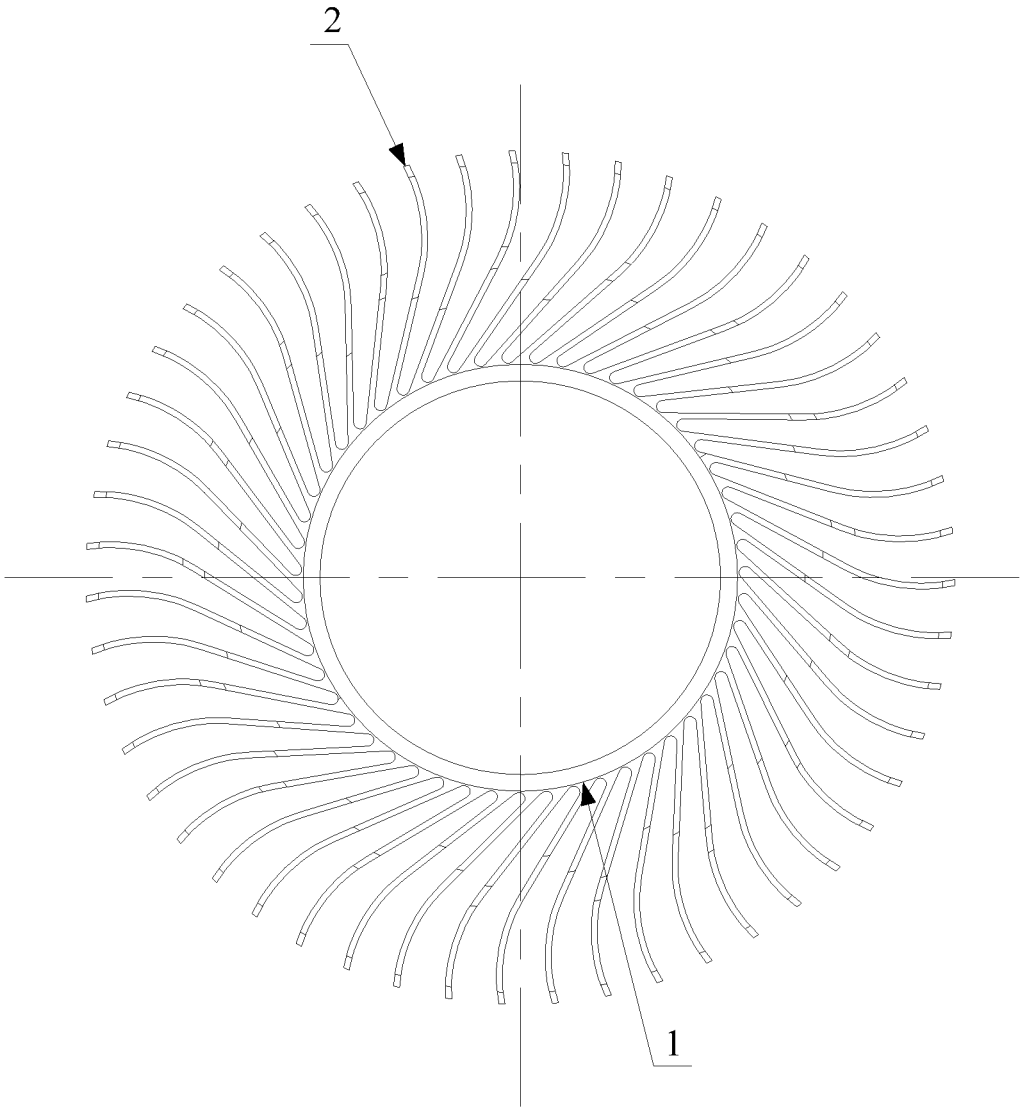
FIG. 1 illustrates a front view of an exemplary cooling fan consistent with disclosed embodiments.

Reference will now be made in detail to exemplary embodiments of the disclosure, which are illustrated in the accompanying drawings. Hereinafter, embodiments consistent with the disclosure will be described with reference to drawings. In the drawings, the shape and size may be exaggerated, distorted, or simplified for clarity. Wherever possible, the same reference numbers will be used throughout the drawings to refer to the same or like parts, and a detailed description thereof may be omitted. It should be noted that the relative arrangement of the components and steps, the numerical expressions, and numerical values set forth in the exemplary embodiments do not limit the scope of the present disclosure unless it is specifically stated otherwise.

Further, in the present disclosure, the disclosed embodiments and the features of the disclosed embodiments may be combined under conditions without conflicts. It is apparent that the described embodiments are some but not all of the embodiments of the present disclosure. Based on the disclosed embodiments, persons of ordinary skill in the art may derive other embodiments consistent with the present disclosure, all of which are within the scope of the present disclosure.

The present disclosure provides a cooling fan capable of reducing the noise generated during the operation and satisfying the desired quietness performance requirement.

Figure 2:
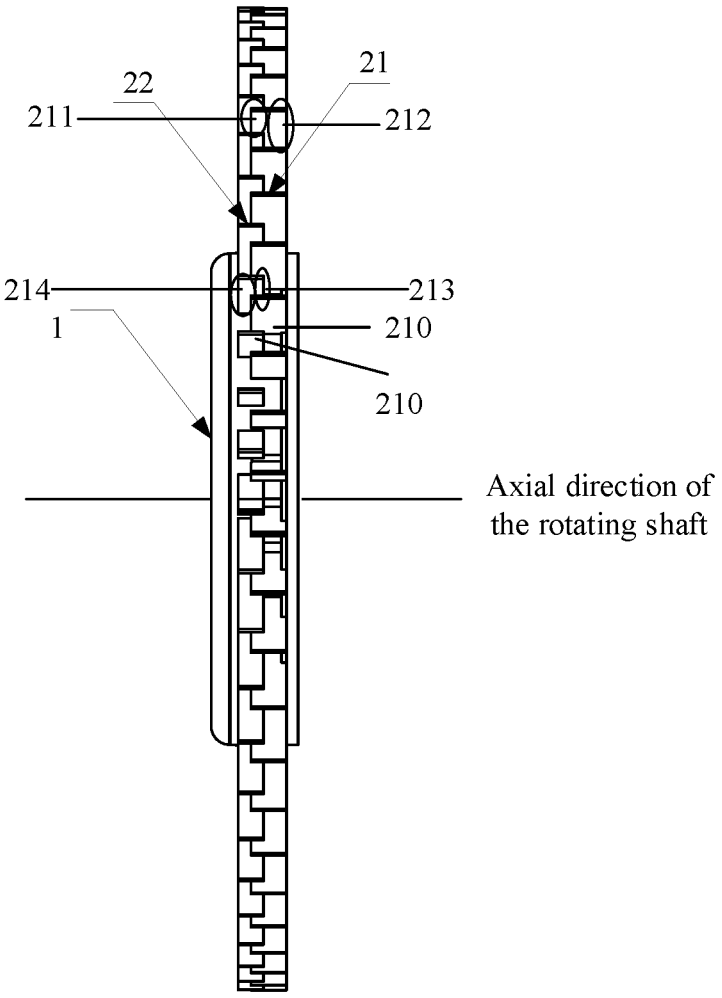
FIG. 2 illustrates a side view of an exemplary cooling fan consistent with disclosed embodiments.
Figure 3:
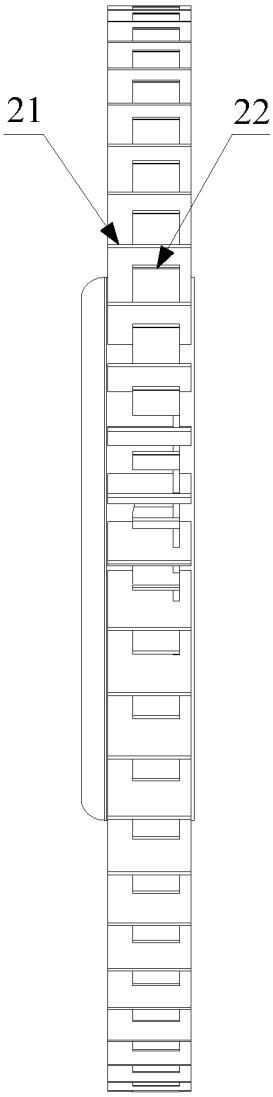
FIG. 3 illustrates a side view of another exemplary cooling fan consistent with disclosed embodiments.
Figure 4:
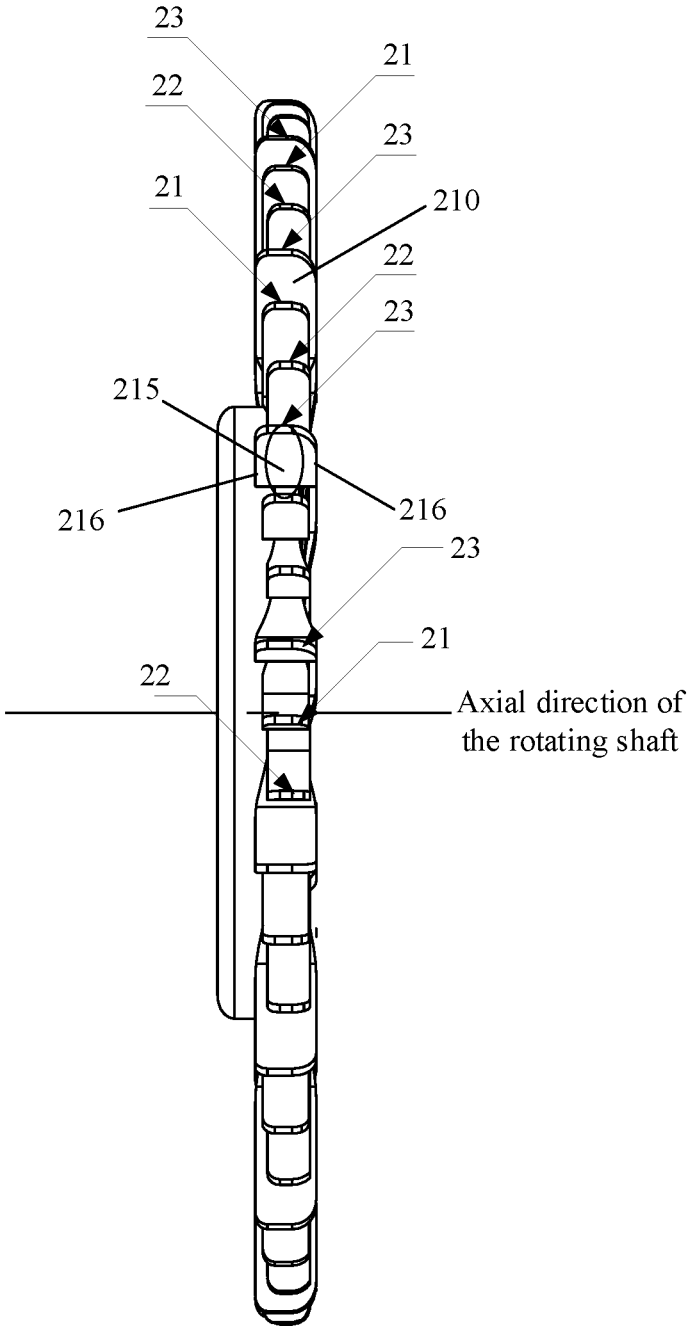
FIG. 4 illustrates a side view of another exemplary cooling fan consistent with disclosed embodiments.

FIG. 1 illustrates a front view of an exemplary cooling fan consistent with disclosed embodiments; FIG. 2 illustrates a side view of an exemplary cooling fan consistent with disclosed embodiments; FIG. 3 illustrates a side view of another exemplary cooling fan consistent with disclosed embodiments; and FIG. 4 illustrates a side view of another exemplary cooling fan consistent with disclosed embodiments.

As shown in FIG. 1 to FIG. 4, the cooling fan may include a plurality of blades 2 disposed in a circumferential direction of a rotating shaft. In particular, the rotating shaft may be connected with the blades 2 through a connector 1. The plurality of blades 2 may include at least two categories of blades, namely first blades 21 and second blades 22. A windward surface 210 of the first blade 21 may include a first alignment part 211 and a first offset part 212. The first blade 21 and the second blade 22 may be no longer completely aligned, i.e., the first blade 21 and the second blade 22 may be arranged in a staggered manner. In one embodiment, the first alignment part 211 of the first blade 21 may be aligned with the entire windward surface or a part of the windward surface of the second blade 22, while the first offset part 212 of the first blade 21 and the windward surface of the second blade 22 may be arranged in the staggered manner. That is, the first offset part of the first blade 21 may be no longer aligned with the second blade 22.

In the disclosed embodiments, through specifically configuring the blades 2, the air guiding state of the first blade 21 and the second blade 22 during the operation may be no longer exactly the same. Thus, the noise generated by the first blade 21 and the second blade 22 may be no longer synchronized, instead, the peaks and valleys of the generated noise may be staggered/misaligned and, accordingly, the sound pressure generated by the cooling fan may be reduced. Meanwhile, through disposing the first blades 21 and the second blades 22 in the staggered manner, the space/gap between the blades 2 may also be increased, such that the blocking coefficient of the cooling fan may also be reduced. Accordingly, the noise generated by the cooling fan may be significantly reduced, thereby meeting the desired quietness performance requirement of the cooling fan.

In one embodiment, as shown in FIG. 2, the windward surface of the second blade 22 may also include a second alignment part 213 and a second offset part 214. The second alignment part 213 of the second blade 22 may be aligned with the first alignment part 211 of the first blade 21, and the second offset part 214 of the second blade 22 and the first alignment part 211 of the first blade 21 may be arranged in the staggered manner. Meanwhile, in the axial direction of the rotating shaft, the second offset part 214 of the second blade 22 and the first offset part 212 of the first blade 21 may be disposed at two sides of the first alignment part 211 of the first blade 21, respectively.

Provided that the first blade 21 has a first offset part which is disposed in a staggered position with respect to the second blade 22, the second blade 22 may be arranged in various ways. In one embodiment, the windward surface of the second blade 22 may also include an alignment part and an offset part, i.e., a second alignment part and a second offset part. The second alignment part of the second blade 22 may be aligned with the first alignment part of the first blade 21. The second offset part of the second blade 22 and the first alignment part of the first blade 21 may be arranged in the staggered manner and, meanwhile, the first offset part of the first blade 21 and the second alignment part of the second blade 22 may be arranged in the staggered manner, in which the offset direction may be the axial direction of the rotating shaft. Thus, the second offset part and the first offset part may be respectively located at two sides of the first alignment part and the second alignment part.

Through configuring each of the windward surface of the first blade 21 and the windward surface of the second blade 22 to have an alignment part and an offset part, the air circulation space between the first blade 21 and the second blade 22 may be enlarged. Thus, the damping coefficient of the cooling fan may be reduced, and the noise generated by the cooling fan may be reduced, accordingly.

In one embodiment, in the axial direction of the rotating shaft, the first blade 21 may have a same size as the second blade 22. That is, in the axial direction of the rotating shaft, the sum of the widths of the first alignment part and the first offset part of the first blade 21 may be equal to the sum of the widths of the second alignment part and the second offset part of the second blade 22, thereby ensuring a desired guiding effect of the cooling fan given the noise reduction of the cooling fan.

In another embodiment, in the axial direction of the rotating shaft, the first blade 21 may have a different size from the second blade 22, as shown in FIG. 3.

Further, the first blade 21 and the second blade 22 may be alternately arranged in the circumferential direction of the rotating shaft. In one embodiment, as shown in FIG. 2 and FIG. 3, every first blade 21 and every second blade 22 may be alternately arranged. In another embodiment, a group of first blades 21 and a group of second blades 22 may be alternatively arranged, which may maximumly increase the gap between the blades 2 and further reduce the sound pressure.

In addition, in the disclosed embodiments, the number of the first blades 21 and the second blades 22 may be determined according to various application scenarios. For example, through increasing the number of the first blades 21 and the second blades 22, the static pressure during the operation of the cooling fan may be further increased, thereby further reducing the noise generated by the cooling fan during the operation.

In another embodiment, as shown in FIG. 3 and FIG. 4, the windward surface of the second blade 22 may only include a second alignment part which is aligned with the first alignment part of the first blade 21. In the cooling fan shown in FIG. 2, the noise reduction may be mainly achieved by changing the installation position of the blade 2. However, the noise reduction may be achieved by other ways. For example, as shown in FIG. 3 and FIG. 4, the windward surface of the second blade 22 may be smaller than the windward surface of the first blade 21 (i.e., in the axial direction of the rotating shaft, the width of the second blade 22 may be smaller than the width of the first blade 21), and the entire windward surface of the second blade 22 may be aligned with the first alignment part of the first blade 21 (i.e., the second blade 22 may only include the second alignment part). The remained part of the windward surface of the first blade 21 may be the first offset part. That is, the part beyond the first alignment part of the first blade 21 may be the first offset part. Thus, the noise generated by the cooling fan in the operation may be reduced, while the manufacturing process may be facilitated.

To facilitate the manufacture of different types of blades 2, in one embodiment, as shown in FIG. 4, all the blades 2 may have one side, which is perpendicular to the axis of the rotating shaft, aligned to each other.

In one embodiment, as shown in FIG. 4, provided that the size of the windward surfaces 210 of the first blade 21 and the second blade 22 are different, the cooling fan may further include a third blade 23. The windward surface 210 of the third blade 23 may include a third alignment part 215 aligned with the first alignment part 211 and the first offset part 212, and a third offset part 216 arranged in a staggered position with respect to the first alignment part 211 and the first offset part 212.

That is, the third blade 23 may have a larger windshield surface area than the first blade 21. A part of the windward surface of the third blade 23, in which the part is aligned with the entire windward surface of the first windshield 21, may be the third alignment part, and remained part of the windward surface of the third blade 23 may be the third offset part.

Through providing the third blade 23, the cooling fan may include at least three blades 2 with different windward areas, which may further enhance the offset effect of the cooling fan, thereby further improving the quietness performance of the cooling fan. In one embodiment, as shown in FIG. 4, in the three types of blades 2, the areas of the windward surfaces of the second blade 22, the first blade 21, and the third blade 23 may be gradually increased.

In certain embodiments, the blades 2 disposed in the circumferential direction of the rotating shaft may include a plurality of blade 2 sets. Each of the blade 2 sets may include a second blade 22, a first blade 21 and a third blade 23 arranged in sequence. Thus, the second blade 22 and the first blade 21 may be always disposed adjacent to each other, the first blade 21 and the third blade 23 may be always disposed adjacent to each other, and the third blade 23 and the first blade 21 may be always disposed adjacent to each other. The structure of the cooling fan may be further balanced, the gap between adjacent blades 2 may be increased, the sound wave propagation differences of different blades 2 may be enhanced. Accordingly, the quietness performance of the cooling fan may be further significantly improved.

The present disclosure also provides an electronic device comprising a heat generating component and a cooling fan for dissipating the heat generated by the heat generating component. The cooling fan may be any of the disclosed cooling fans.

Because the electronic device includes any one of the disclosed cooling fan, the features of the electronic device may be referred to the corresponding description of the cooling fans, and the details are not described herein again.

In the disclosed embodiments, the structure and layout of the plurality of blades arranged in the circumferential direction of the rotating shaft in the cooling fan have been specifically designed. In particular, the plurality of blades in the cooling fan may include at least two categories of blades, namely first blades and second blades. The windward surface of the first blade may include a first alignment part and a first offset part. The first blade and the second blade may be no longer completely aligned. Instead, the first alignment part of the first blade may be aligned with the windward surface of the second blade, and the first offset part of the first blade and the windward surface of the second blade may be arranged in the staggered manner.

Through arranging the first blades and the second blades in the staggered manner, the space/gap between the blades may be increased. Thus, the blocking coefficient of the cooling fan may be reduced and, meanwhile, the peaks and valleys of the generated noise may be staggered/misaligned. Accordingly, the sound pressure generated by the cooling fan may be reduced, and the desired quietness performance requirements of the cooling fan may be satisfied.

Various embodiments of the present disclosure are described in a progressive manner, in which the structure of each part focuses on the difference from the existing structure. The overall and partial structure of the electronic device and the cooling fan can be obtained by combining the above multiple parts of the structure.

Various embodiments have been described to illustrate the operation principles and exemplary implementations. It should be understood by those skilled in the art that the present disclosure is not limited to the specific embodiments described herein and that various other obvious changes, rearrangements, and substitutions will occur to those skilled in the art without departing from the scope of the disclosure. Thus, while the present disclosure has been described in detail with reference to the above described embodiments, the present disclosure is not limited to the above described embodiments, but may be embodied in other equivalent forms without departing from the scope of the present disclosure, which is determined by the appended claims.

What is claimed is:

1. A cooling fan, comprising:

a plurality of blades disposed in a circumferential direction of a rotating shaft, the plurality of blades being connected to the rotating shaft through a circumferential side of a central connector and arranged entirely at the circumferential side of the central connector, wherein:

the plurality of blades comprises a first blade and a second blade, wherein:

a windward surface of the second blade is the same as a windward surface of the first blade, wherein the windward surface is opposite a direction of airflow generated by the cooling fan, the windward surface of the first blade is defined by a width of the first blade in an axial direction of the rotating shaft, and the windward surface of the second blade is defined by a width of the second blade in the axial direction of the rotating shaft;

the windward surface of the first blade includes a first alignment part and a first offset part, the windward surface of the second blade includes a second alignment part and a second offset part, the first alignment part is aligned with the second alignment part, the first offset part and the windward surface of the second blade are arranged in a staggered manner, the second offset part and the windward surface of the first blade are arranged in a staggered manner, and in the axial direction of the rotation shaft, the second offset part and the first offset part are disposed at two sides of the first alignment part, respectively.

2. The cooling fan according to claim 1, wherein:

the first blade and the second blade being alternately arranged in the circumferential direction of the rotating shaft.

3. An electronic device, comprising:

a heat generating component disposed in the electronic device, being configured to perform processing function of the electronic device; and a cooling fan for cooling the heat generating component disposed apart from the heat generating component, wherein the cooling fan comprises a plurality of blades disposed in a circumferential direction of a rotating shaft, the plurality of blades being connected to the rotating shaft through a circumferential side of a central connector and arranged entirely at the circumferential side of the central connector, wherein:

the plurality of blades comprises a first blade and a second blade, wherein:

a windward surface of the second blade is the same as a windward surface of the first blade, wherein the windward surface is opposite a direction of airflow generated by the cooling fan, the windward surface of the first blade is defined by a width of the first blade in an axial direction of the rotating shaft, and the windward surface of the second blade is defined by a width of the second blade in the axial direction of the rotation shaft;

the windward surface of the first blade includes a first alignment part and a first offset part, the windward surface of the second blade includes a second alignment part and a second offset part, the first alignment part is aligned with the second alignment part, the first offset part and the windward surface of the second blade are arranged in a staggered manner, the second offset part and the windward surface of the first blade are arranged in a staggered manner, and in the axial direction of the rotating shaft, the second offset part and the first offset part are disposed at two sides of the first alignment part, respectively.

4. The electronic device according to claim 3, wherein:

the first blade and the second blade being alternately arranged in the circumferential direction of the rotating shaft.

* * * * *